US005465429A

United States Patent [19]

Rogers et al.

[11] Patent Number: 5,465,429

[45] Date of Patent: Nov. 14, 1995

[54] OUTSIDE HOLSTER AND AN INSIDE ARTICLE OF CLOTHING

[75] Inventors: William H. Rogers; Norman E. Clifton, Jr., both of Jacksonville, Fla.

[73] Assignee: Safariland Ltd., Inc., Ontario, Calif.

[21] Appl. No.: 176,767

[22] Filed: Jan. 5, 1994

[51] Int. Cl.[6] ..... A41F 19/00

[52] U.S. Cl. ..... 2/300; 2/311; 2/312; 224/911; 224/912

[58] Field of Search ..... 2/300, 311, 312, 2/314, 317, 318, 319, 336, 338, 102, 2, 2.5, 115, 108; 224/911, 912, 271, 272, 901, 252

[56] References Cited

U.S. PATENT DOCUMENTS 2,423,531 7/1947 Theis .
2,693,654 11/1954 Clark .
3,392,729 7/1968 Lenoir .
3,741,376 6/1973 Brown .
3,865,290 2/1975 Sperling .
4,235,356 11/1980 Atchisson ..... 224/911 X
4,262,832 4/1981 Perkins ..... 224/911 X
4,294,385 10/1981 Rogers .
5,067,642 11/1991 Fodge ..... 224/911 X

*Primary Examiner*—Clifford D. Crowder
*Assistant Examiner*—Gloria Hale
*Attorney, Agent, or Firm*—Arthur G. Yeager

[57] ABSTRACT

A holster worn outwardly of an article of clothing and attached to a snug body engaging inside article of clothing in the form of a belt or an undershirt or a bullet-proof vest, the attachment including spaced keys mounted on a semi-flexible inside support member attached at selected positions on the inside article of clothing and keyhole or keyways attached to the holster.

24 Claims, 3 Drawing Sheets

OUTSIDE HOLSTER AND AN INSIDE ARTICLE OF CLOTHING

BACKGROUND OF THE INVENTION

Holsters for guns, reloaders, handcuffs, etc., are usually carried on a waist belt or a shoulder harness from which the holster is suspended by a loop on the holster or by snaps or wire hooks on the holster engaging a snap portion or a grommet on the belt. Regardless of the type of attachment it is necessary for the belt and the holster both to be outwardly of the clothing of the wearer. In some instances the wearer would like for the holster to be outside of the clothing so as to be readily available, and for the supporting belt or harness to be hidden. It is difficult to achieve this combination unless there are holes in the clothing through which the holster can be connected to the belt or harness. U.S. Pat. No. 5,067,642 has attempted to solve this problem by a complicated apparatus including a spring biased segmented hub clamping around a conical expander knob. A simple, inexpensive device remains needed for this purpose and which is more readily adaptable to various and individual needs of the users.

It is an object of this invention to provide a simple means for connecting a holster outwardly of an article of clothing to a snug fitting inside article of clothing, such as an elastic belt or a tight fitting undershirt or T-shirt, or to a bullet proof vest, without the necessity of piercing the clothing. It is another object to provide such a connecting device by the engagement of rigid keys to keyways or keyholes. Still other objects will become apparent from the more detailed description which follows.

BRIEF SUMMARY OF THE INVENTION

This invention relates to a combination of an inside article of clothing such as a belt, T-shirt or vest, and an outside holster including means for detachably connecting the inside article of clothing to a wearer, selective means disposed on the inside article of clothing for detachably connecting the outside holster to the inside article of clothing including at least a pair of spaced outwardly projecting keys having enlarged free heads and smaller shanks attached to the inside article of clothing with the heads projecting outwardly from the user's body and adapted to be attached to a holster; the selective means including a pair of spaced slots disposed on the holster and facing a body of a user and being detachably connected to the pair of spaced keys.

In specific and preferred embodiments the belt is worn under a shirt and/or an undershirt and the holster is attached to the keys with the shirt stretched over the keys with no holes in the shirt. Other embodiments include a selectively movable semi-flexible member carrying the keys and supported by the inside article of clothing to distribute the weight of the holster and the holstered object, and an adjustment means for positioning the holster with respect to the keyways at different angles with respect to the inside article of clothing. In further embodiments the adjustment means may be pivotal to angularly adjust the keyways or may be a detach-able pad carrying the keys and adjustable on the inside article of clothing.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

This invention is best understood by considering the following description in connection with the accompanying drawings of FIGS. 1–5.

Figure 1:
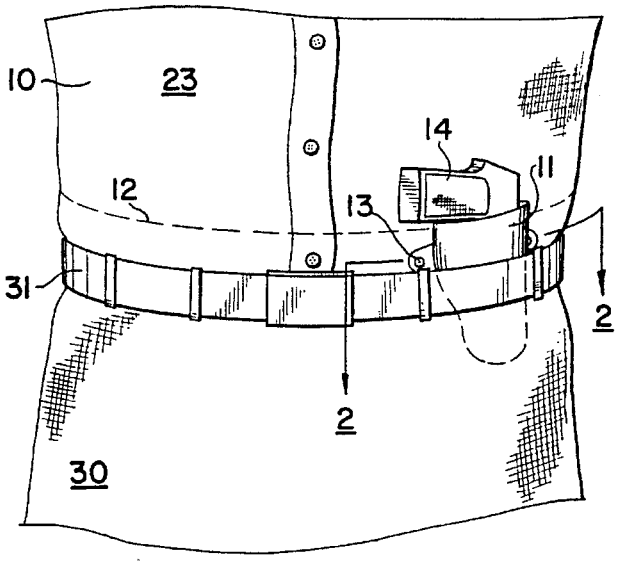
FIG. 1 is a perspective view of a wearer using the outside holster attached to an inside article of clothing in accord with this invention.

In FIG. 1 there is an illustration of a person wearing the outside holster attached to an inside article of clothing according to this invention. The wearer 10, a police officer, for example, is wearing an outer shirt 23, trousers or skirt 30, and an outer waist belt 31. An inside article of clothing in the form of a wide stretchable belt 12 is worn around the waist under the outer shirt 23 next to the skin of the wearer but preferably outside the underwear of the wearer. Preferably there is only one layer of clothing, e.g., the outer shirt 23 outwardly covering belt 12 for the most efficient use of this invention, which will be more fully explained hereinafter. Holster 11 includes an adapter 13 which is detachably connected to belt 12 with shirt 23 therebetween. This arrangement positions the holstered object, i.e., handgun 14 readily accessible while the belt 12 supporting holster 11 and gun 14 is hidden from view and with the lower end of the holster 11 inside of trousers 30 or shirt 35.

Figure 2:
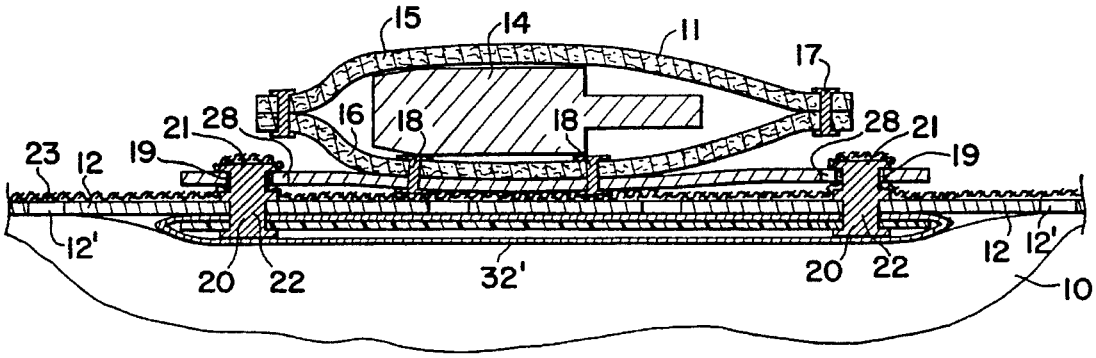
FIG. 2 is a cross-sectional view taken along line 2—2 of FIG. 1.

FIG. 2 depicts in a cross-sectional view the detachable connection of holster 11 and adapter 13 to belt 12 for normal use. Holster 11 may be constructed of two layers of leather or a leather substitute; outside layer 15 and inside layer 16 are joined together with a cavity between layers 15 and 16 molded to fit the outside contours of the handgun that is to be carried therein. The perimeters of layers 15 and 16 are fastened to each other by sewing, by rivets, by nuts and bolts, or by a combination of any of these means. In FIG. 2 there are shown rivets 17 for ease of illustration.

Adapter 13 may be a strip of stiff leather or a plastic substitute therefor which is attached to holster 11 by nuts and bolts 18. Other fastening means may be used, depending on the circumstances well known in the art. If holster 11 is to be used by connection to other supports than inside belt 12, the connection between adapter 13 and holster 11 should be easily detachable and nuts and bolts 18 provide such capability. If holster 11 and adapter 13 are never used separately for other purposes, holster 11 and adapter 13 may be joined in a permanent fashion, e.g., by sewing or by rivets. An adjustable connection between holster 11 and adapter 13 is described below in a preferred embodiment with respect to FIG. 4. Adapter 13 has spaced keyholes or keyways 19 which pierce through the entire thickness of adapter 13. Keyways 19 are intended to engage keys in the form of headed pin 20 with a small shank 22 and an enlarged head 21 on belt 13 and, therefore, must be sized and positioned to engage headed pins 20 properly so as to suspend holster 11 and gun 14 in an operable position for the user. It may be seen in FIG. 2 that shirt 23 is draped over the outside of belt 12 and headed pins 20. When headed pins 20 are pushed through keyways 19, a portion of shirt 23 is also pushed through keyways 19 and remains covering headed pins 20 without any hole or other puncture of shirt 23. It should be apparent that this attachment is operable, if headed pins 20, keyways 19, and shirt 23 are compatibly designed to provide a sloppy fit between shank 22 and reduced slot 29 of keyway 19. The thickness and flexibility of shirt 23 must permit the bending and stretching necessary to fit around enlarged heads 21 and be constricted by slot 29. Heavy jackets probably could not be used in place of a thin shirt in this combination without providing for substantially more clearances. Similarly, headed pins 20 are rigid and rounded articles to minimize any damage to the fabric of the shirt 23. Keyways 19 must be appropriately designed to allow the heads 21 of pins 20 to readily pass through at enlarged portions 28 and yet be small enough along reduced slots 29 to inhibit inadvertent detachment of pins 20 from keyways 19.

Figure 3:
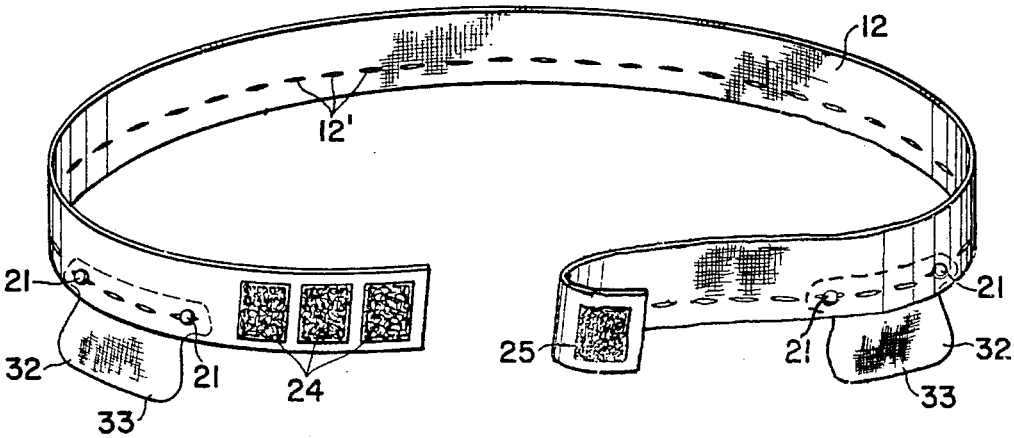
FIG. 3 is a perspective view of the inside article of clothing in elastic belt form according to a first embodiment of this invention.

In FIG. 3 there is shown a-typical inside belt 12 used according to the first embodiment of this invention. Belt 12 must, of course, fit snugly around the waist of the wearer, be closable, and carry at least two pins 20 with the enlarged heads 21 extending outwardly. Preferably the belt is wide and elastic so as to stretch and contract with the torso of the wearer. Ideally a nonstretchable belt may be used but is not entirely satisfactory. It is to be expected that the wearer, particularly a police officer, will in the normal course of his duties be bending, walking, running, and twisting in various ways that might tend to make a nonstretchable belt uncomfortable, and perhaps even injurious, to the wearer. The closure means for belt 12 may be any convenient type, e.g., a buckle, snaps, a zipper, or the like. FIG. 3 shows the use of a "Velcro" hook and loop fastener including a pad 25 of fabric hooks and an elongated pad or a plurality of pads 24 of fabric loops to accommodate for different sizes of waists of users. Belt 12 preferably includes a plurality of button holes 12' equally spaced from each other and extending substantially along the length of belt 12 so that more than one holster may be supported thereby, for example, holsters for magazine, reloader and handcuffs or other accessories. Pins 20 are shown as a spaced pair located on the left side of the wearer. The pins 20 can be in any number desired and can be located wherever the wearer wishes along the belt 12 and in the button holes 12'. Preferably pins 20 are assembled in spaced pairs so as to accommodate the pair of keyways on adapter 13. Multiple pairs of pins 20 might be employed to accommodate other holster locations and to accommodate more than one holster at one time, e.g., a handgun holster and a reloader holster or more than one handgun holster. The pins 20 themselves are rigid structures with enlarged heads 21 and a smaller shank 22 to permit the use of keyways 19 on the adapter 13 so as to provide the preferred attachment for keeping the holster in place during all sorts of body contortions. Furthermore, since the belt 12 is stretched around the waist the stretching causes the pins 20 to be forced apart enhancing the positioning of the pins 20 with their shanks 22 in the opposite end portions of the reduced slots 29 of keyways 19.

An added feature to belt 12 that is particularly useful to many wearers is the inclusion of at least a pair of spaced undersupports 32 on the belt 12 at the sides of the wearer and which depend downwardly from the belt 12. The purpose of undersupports 32 is to provide a weight distribution of the holster and the object it is carrying and to maintain the holster 11 locked in place on the spaced pins 20. These undersupports 32 include a shaped member of stiff, but thin plastic which is flexible and will conform to the body and cause its lower portion 33 to slightly bend outwardly and frictionally bear against the material of the trousers or skirt 30 and/or the waistband thereof of the wearer so as to counteract the upward movement of belt 12. Undersupports 32 also provide support for the holster 11 onto the hips of a wearer and or the abdomen if the holster 11 is worn in the appendix or cross-draw position. Of course, the outer shirt 23 does carry some of the weight of the holster and holstered object and the remainder is distributed by the waist belt 12 to the torso of the wearer, primarily to the hips if the undersupports 32 are placed thereat. Preferably, when a pair of spaced pins 20 are moved into a different position on the belt 12, the corresponding undersupport is likewise moved and this also provides the correct spacing for such spaced pins 20 to lock up onto the reduced slots 29 of keyways 19.

Figure 4:
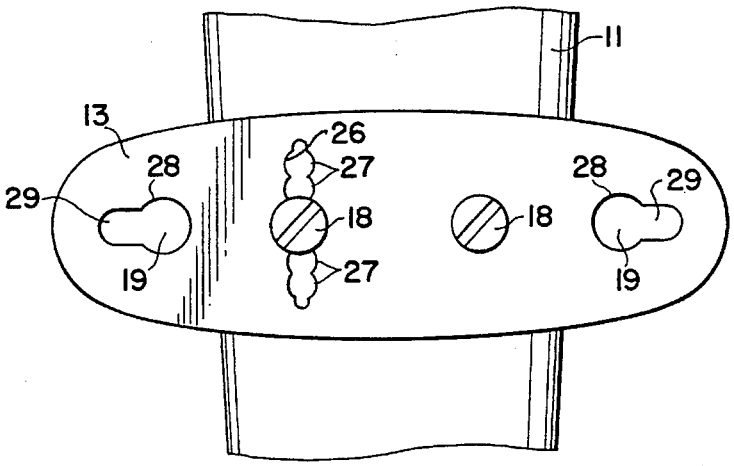
FIG. 4 is a partial rear elevational view of the holster of FIG. 1 depicting the adjustable adapter carrying the keyways.

FIG. 4 shows adapter 13 as including a narrow stiff strip of leather or leather substitute that is somewhat flexible so as to conform to the body and match the holster 11. The central portion of adapter 13 is employed for attachment to holster 11, which, as mentioned above, may be permanent or detachable. Detachable connection preferably is by bolts 18 wherein a nut is embedded within inside layer or panel 16 of holster 11, and bolts 18 pass through suitable holes in adapter 13 and are tightened down on the nuts in holster 11. The preferred arrangement shown here is that the right hand screw 18, shown in FIG. 4 or the left hand screw 18 if viewing the holster in FIG. 1, serves as a pivot while the left hand screw 18 engages an arcuate slot 26 so as to provide some angular adjustment about the pivot between holster 11 and adapter 13. Arcuate slot 26 is shown to have aligned pairs of arcuate recesses 27 along the perimeter of slot 27 to provide more stable seating for an enlargement of the shank of bolt 18 or partial seating of the head of bolt 18 which passes through slot 26. Keyways 19 are placed and shaped so as to engage spaced pins 20. One end 28 of each keyway 19 is of larger dimension or diameter and the other slotted end 29 of each slot 19 is of a smaller dimension vertically. These larger and smaller dimensions 28 and 29 are compatible with the sizes of enlarged head 21 and smaller shank 22 of pins 20, respectively. Large end 28 of slot 19 will permit large head 21 of pin 20 to pass through, but reduced slot end 29 of keyway 19 will not permit large head 21 of pin 20 to do the same. Reduced slot end 29 of keyway 19 will, however, permit small shank 22 of pin 20 to move along the length thereof. Keyways 19 are also oriented in a special manner so as to make adapter 13 easily attachable to pins 20 and to resist unintended detachment. The large ends 28 of keyways 19 face each other while the small ends 29 face away from each other. In other words, keyways 19 are oriented so that their lengthwise direction is parallel to the lengthwise direction of adapter 13 with the spaced slots 19 positioned with their large ends 28 closer to each other than their small ends 29. It should be apparent that holster 11 might be made originally to include lateral ears with keyways 19 and thereby eliminate the necessity for a separate adapter 13. Keyways 19 and slot 26 may be made with a metal or plastic plate attached to the basic leather strip of adapter 13 so as to provide a rigid edge to the keyways 19 and slot 26 that will not soften or curl with wear. Since the elastic belt 12 is stretched the pins 20 are forced outwardly to the opposite slot ends 29 to inhibit the dislodgement of pins 20 from their engagement with slot ends 29 during wear of belt 12.

Figure 5:
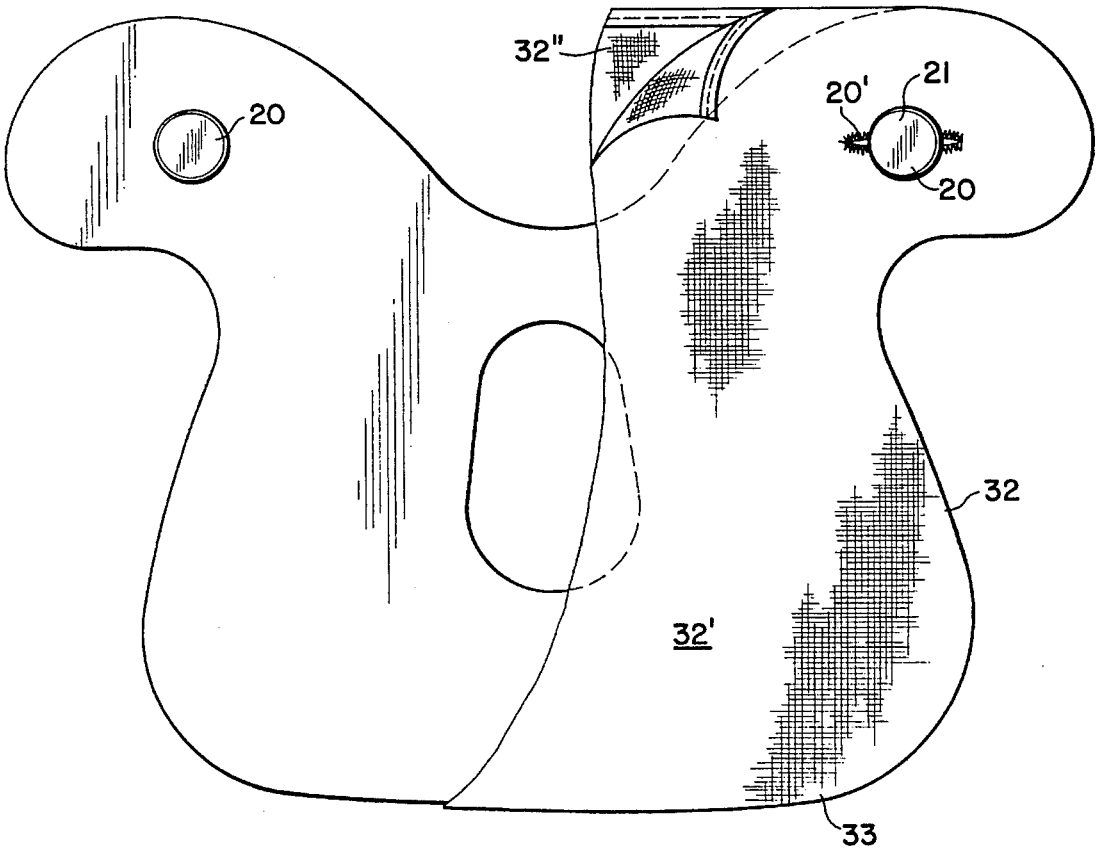
FIG. 5 is an enlargement of the undersupport for the holster attached to the belt shown in FIG. 3.

The undersupport 32 is depicted in FIG. 5 approximately full size with a cover 32' of cotton or other fabric material covering undersupport 32. The cover 32' includes an open top 32" and a pair of spaced button holes, including button hole 20', through which pins 20 and their enlarged heads 21 extend. The covers 32' are to present a softer engagement with the skin of a wearer in the event that the belt 12 is worn against the skin. Of course the belt 12 might be worn outwardly of an undershirt and underpants if preferred by the wearer. Also, the covers 32' can be washed and are thus removable from undersupports 32.

Figure 6:
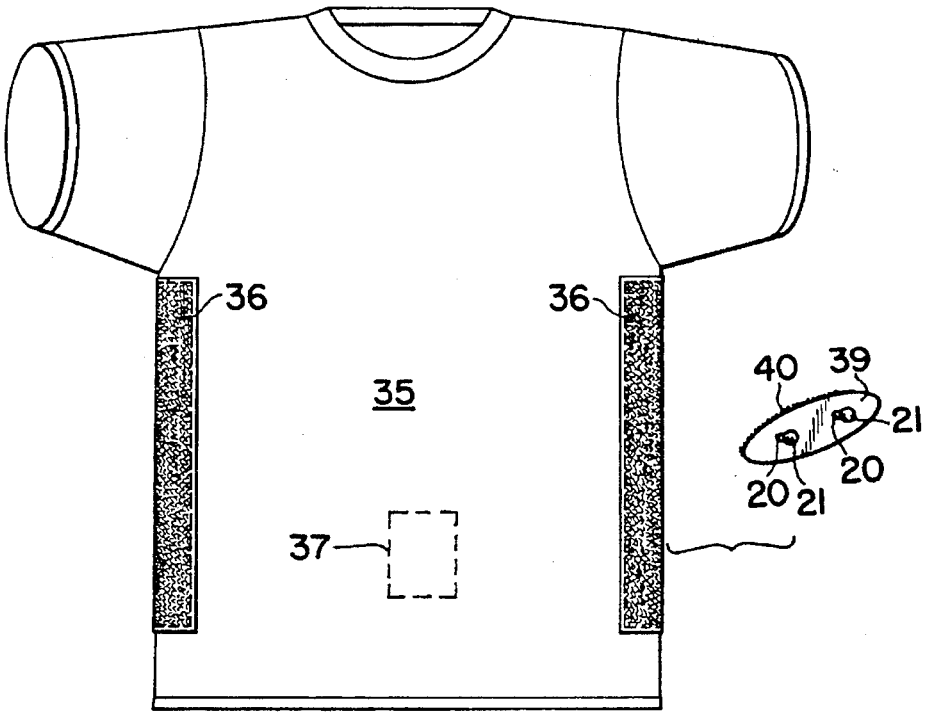
FIG. 6 is an illustration of a second embodiment of the invention with the spaced pins attached to another undersupport detachably connected to a tight fitting T-shirt article of inside clothing.

The inside article of clothing in a second embodiment shown in FIG. 6, is a tight long T-shirt 35 to which is sewn or otherwise connected spaced VELCRO fabric loop strips 36 sewn along the side seams of T-shirt 35. Of course, the strips 36 can be enlarged to accommodate the cross-draw position and/or other fabric loop pads 37 may be located in other positions, as desired. The spaced headed pins 20 in this embodiment are carried by a stiff but slightly flexible undersupport 39 with a VELCRO hook pad 40 attached to and extending oppositely from heads 21 of pins 20. The undersupport 39 can be moved and located onto any part of the fabric loop strips 36, and/or more than one undersupport 39 may be employed as set forth above with respect to the first embodiment described in FIGS. 1–5. If desired the VELCRO strips 36 may be replaced by reinforcing strips sewn to T-shirt 35 and containing spaced apart button holes, similar to button holes 12' on belt. In such event the VELCRO hook pad 40 would be eliminated, and support 39 would be covered, similar to covering 32' on undersupport 20; due to contact with the skin of the wearer, i.e., undersupport 39 would be inside of T-shirt 35 and the headed pins 20 would protrude through such button holes.

Figure 7:
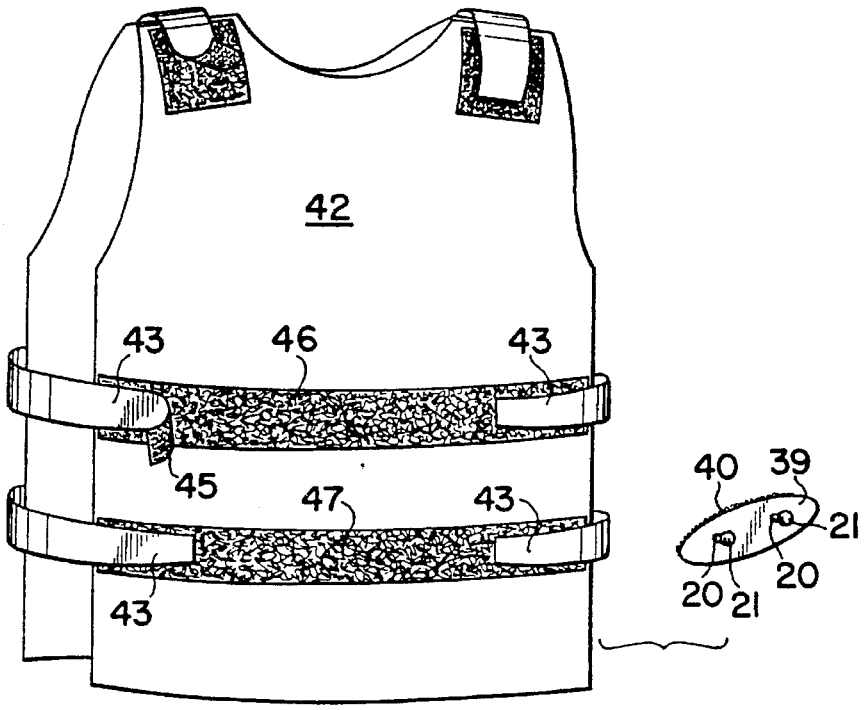
FIG. 7 is an illustration of a third embodiment of the invention with the spaced pins attached to another undersupport detachably connected to an inside vest, preferably a bullet proof vest article of clothing.

The inside article of clothing, in a third embodiment shown in FIG. 7, is a vest, preferably a bullet-proof vest 42 which has side flaps 43 and 44, which carry VELCRO hook pads, including hook pad 45 cooperating with frontal VELCRO loop strips or pads 46 and 47. The same spaced pins 20 with heads 21 and undersupport 39 and VELCRO hook pad 40 is provided to connect such pad to such bullet-proof vest 42 adjacent the waist of the wearer. As described hereinabove with respect to FIG. 6, other loop pads can also be applied if desired to the bullet-proof vest 42 at any desired location.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A combination of an inside article of clothing and an outside holster for positioning a holstered object outwardly of an outwardly worn clothing of a wearer comprising an inside article of clothing for fastening around a wearer, a pair of outwardly projecting spaced pins having outer free enlarged heads and smaller shanks attached to the inside article of clothing, said enlarged heads being adapted to be engaged by spaced portions of outwardly worn clothing, a holster for carrying a holstered object, the holster including a pair of spaced keyways having enlarged openings disposed adjacent each other for receiving therethrough said enlarged heads and adapted to receive spaced portions of outwardly worn clothing of a wearer, said keyways having elongated slots extending substantially in alignment and disposed remotely from each other for receiving therethrough said smaller shanks and adapted to receive spaced portions of outwardly worn clothing of a wearer, the holster being readily attachable to and detachable from said inside article of clothing without damaging spaced portions of outwardly worn clothing that is engageable between said pins and said keyways.

2. The combination as defined in claim 1 wherein said inside article of clothing is a tight fitting T-shirt.

3. The combination as defined in claim 1 wherein said inside article of clothing is a vest.

4. The combination as defined in claim 3 wherein said vest is a bullet-proof vest.

5. The combination as defined in claim 1 wherein said holster includes an inwardly directed back portion and an adapter connected to said back portion, said adapter carrying said spaced keyways.

6. The combination as defined in claim 1 wherein said inside article of clothing includes an elastic inside waist belt, said belt carrying said spaced pins adjacent the waist of a wearer.

7. The combination as defined in claim 6 wherein said inside waist belt includes at least one undersupport depending downwardly therefrom and located beneath said pair of spaced pins to provide support for said holster and distribute weight of said holster and its holstered object to a wearer.

8. The combination as defined in claim 7 wherein said undersupport is a thin curved member of semi-flexible material and having upper ends connected respectively by said pins to said belt.

9. The combination as defined in claim 8 further comprising a soft material cover encasing said undersupport.

10. The combination as defined in claim 6 further comprising means for adjusting an angular orientation of said slots with respect to said belt.

11. The combination as defined in claim 10 wherein said means for adjusting includes an arcuate slot.

12. The combination as defined in claim 10 wherein said means for adjusting includes a pair of spaced bolts, one said bolt being a pivot around which said holster and said adapter are pivotable with respect to each other, another said bolt being tightenable at a selected position along said arcuate slot.

13. The combination as defined in claim 12 wherein said arcuate slot includes a plurality of spaced seats, said another bolt being tightenable and seatable in any of said plurality of said seats along said arcuate slot.

14. The combination as defined in claim 6 wherein said inside waist belt includes a pair of spaced undersupports depending downwardly therefrom, one said undersupport being located beneath said pair of spaced pins to provide support for said holster and distribute weight of said holster and its holstered object to a wearer.

15. The combination as defined in claim 14 wherein said undersupports are located adjacent respective hips of a wearer, said undersupports being bendable by stretching of said belt around a wearer to cause its lower end to be forced upwardly and outwardly of a wearer minimizing upward movement of said belt during activity of a wearer.

16. The combination as defined in claim 15 wherein said undersupports include a lower edge portion adapted to be engaged with an underside of a waistband of an outer article of clothing of a wearer.

17. The combination as defined in claim 1 wherein said inside article of clothing includes a readily releasable fastener means, said fastener means including a plurality of hooks on a pad means and a plurality of loops on another cooperating pad means, one of said pad means carrying said pair of spaced pins and another of said pad means being attached to said article of clothing.

18. The combination as defined in claim 17 wherein said another pad means includes a plurality of spaced pads.

19. The combination as defined in claim 18 wherein said spaced pads include a pad located adjacent each hip of a wearer.

20. The combination as defined in claim 18 wherein said spaced pads include a pad adjacent an armpit of a wearer.

21. The combination of an inside elastic belt, a holster, and a holster adapter comprising a wide elongated elastic belt adapted to be worn under outer clothing of a wearer, a pair of spaced pins projecting outwardly from said belt, said pins each having an enlarged head and a smaller shank, a holster, and an adapter detachably connected to said belt, means for connecting said adapter to said holster including a selective pivotal means for positioning said holster at various angular positions with respect to said adapter, said adapter having two spaced keyways adapted to respectively engage said pins, each said keyways having an enlarged opening slightly larger than said head of each said pin and a slot smaller than the said head and larger than said shank of said pin, said keyways being oriented with the length of said slots being generally parallel to a length of said belt around a waist of a wearer, said enlarged openings of said keyways being closer to each other than respective said slots.

22. The combination as defined in claim 21 wherein said selective pivotal means includes a pair of spaced bolts connecting said holster to said adapter, one of said bolts being a pivot about which said holster and said adapter move with respect to each other, said adapter having an arcuate slot, another of said bolts being engaged with said arcuate slot, said arcuate slot having along opposite edges thereof a plurality of seats adapted to receive and hold said another bolt in any selected position in one of said seats.

23. The combination as defined in claim 21 wherein said belt includes a plurality of spaced button holes along its length, said pair of spaced pins being selectively positioned in selected said button holes.

24. The combination as defined in claim 23 further comprising a support on which said pair of spaced pins are mounted.

* * * * *